US007172428B2

(12) United States Patent
Huang

(10) Patent No.: US 7,172,428 B2
(45) Date of Patent: Feb. 6, 2007

(54) ELECTRONIC DEVICE HAVING A PIVOTABLE ELECTRICAL CONNECTOR, AND ELECTRICAL CONNECTOR ASSEMBLY

(76) Inventor: Yea-Yen Huang, 2F, No. 501-13, Chung-Cheng Rd., Hsin-Tien City, Taipei Hsien (TW)

( * ) Notice: Subject to any disclaimer, the term of this patent is extended or adjusted under 35 U.S.C. 154(b) by 0 days.

(21) Appl. No.: 11/334,242

(22) Filed: Jan. 18, 2006

(65) Prior Publication Data

US 2006/0160377 A1 Jul. 20, 2006

(30) Foreign Application Priority Data

Jan. 19, 2005 (TW) ..... 94101543 A

(51) Int. Cl.
*H01R 39/00* (2006.01)

(52) U.S. Cl. ..... 439/11; 439/31; 439/640

(58) Field of Classification Search ..... 439/11, 439/638, 13, 31, 640, 502
See application file for complete search history.

(56) References Cited

U.S. PATENT DOCUMENTS 2,753,531 A * 7/1956 Butler ..... 333/261
6,544,075 B1 * 4/2003 Liao ..... 439/638
6,551,142 B2 * 4/2003 Eisenbraun ..... 439/668
6,612,874 B1 * 9/2003 Stout et al. ..... 439/640
6,786,734 B2 * 9/2004 Yu ..... 439/11
2004/0229478 A1 * 11/2004 Chen ..... 439/11

* cited by examiner

*Primary Examiner*—Hien Vu
(74) *Attorney, Agent, or Firm*—Ladas and Parry LLP

(57) ABSTRACT

An electronic device includes a hollow pivot member interconnecting a main housing and a connector housing of an electrical connector such that the pivot member is rotatable relative to the electrical connector about a first axis and relative to main housing about a second axis perpendicular to the first axis, and a wire unit extending from the connector housing through the pivot member and into the main housing and interconnecting electrically a conductive terminal unit of the electrical connector and a circuit unit in the main housing. Relative rotation between the pivot member and the connector housing about the first axis is prevented by a first positioning unit. Relative rotation between the pivot member and the main housing about the second axis is prevented by a second positioning unit.

11 Claims, 15 Drawing Sheets

ELECTRONIC DEVICE HAVING A PIVOTABLE ELECTRICAL CONNECTOR, AND ELECTRICAL CONNECTOR ASSEMBLY

CROSS-REFERENCE TO RELATED APPLICATION

This application claims priority of Taiwanese Application No. 094101543, filed on Jan. 19, 2005.

BACKGROUND OF THE INVENTION

1. Field of the Invention

The invention relates to an electronic device and electrical connector assembly, more particularly to an electronic device and electrical connector assembly including a pivotable electrical connector.

2. Description of the Related Art

A personal computer is usually mounted with a plurality of connecting ports, each of which can be connected electrically to a corresponding peripheral device by means of a corresponding electrical connector, such as a USB connector, an IEEE connector or a PS2 connector. When a personal computer is placed in a limited space (e.g., the computer housing is disposed adjacent to a wall), it is difficult to connect electrically and securely each electrical connector to a respective connecting port. Furthermore, wire entanglement cannot be avoided.

SUMMARY OF THE INVENTION

Therefore, the object of the present invention is to provide an electronic device and electrical connector assembly including a pivotable electrical connector that can be positioned by a positioning unit.

According to one aspect of the present invention, an electronic device comprises:

a main housing housed with a circuit unit and having a coupling end portion formed with an opening unit;

an electrical connector including a connector housing having an insertion end portion, and a coupling end portion opposite to said insertion end portion in a longitudinal direction, said coupling end portion of said connector housing being formed with an opening unit, and a conductive terminal unit mounted in said connector housing;

a hollow pivot member having a first pivot end connected pivotably to said coupling end portion of one of said connector housing of said electrical connector and said main housing such that said pivot member is rotatable relative to said one of said connector housing of said electrical connector and said main housing about a first axis perpendicular to the longitudinal direction, and an open second pivot end opposite to said first pivot end along a second axis that is perpendicular to the first axis, said second pivot end being disposed in said main housing and being connected pivotally to said coupling end portion of the other one of said connector housing of said electrical connector and said main housing such that the other one of said connector housing of said electrical connector and said main housing is rotatable relative to said pivot member about the second axis, said pivot member further having an annular outer surface formed with an annular groove that is disposed between said first and second pivot ends so as to define an intermediate neck portion interconnecting said first and second pivot ends and journalled within said pivot hole in said coupling end portion of the other one of said connector housing of said electrical connector and said main housing, said first pivot end being formed with an opening unit;

a wire unit for interconnecting electrically said conductive terminal unit of said electrical connector and said circuit unit in said main housing, said wire unit extending through said opening unit in said connector housing of said electrical connector and into said pivot member via said opening unit in said first pivot end thereof, said wire unit further extending from said second pivot end of said pivot member into said main housing via said opening unit in said coupling end portion thereof;

a first positioning unit disposed between said coupling end portion of said one of said connector housing of said electrical connector and said main housing and said first pivot end of said pivot member for positioning said pivot member relative to said one of said connector housing of said electrical connector and said main housing so as to prevent relative rotation between said one of said connector housing of said electrical connector and said main housing and said pivot member about the first axis; and a second positioning unit disposed between said coupling end portion of the other one of said connector housing of said electrical connector and said main housing and said second pivot end of said pivot member for positioning the other one of said connector housing of said electrical connector and said main housing relative to said pivot member so as to prevent relative rotation between said pivot member and the other one of said connector housing of said electrical connector and said main housing about the second axis.

According to another aspect of the present invention, an electrical connector assembly comprises:

a first electrical connector including a first housing having a coupling end portion, and a first conductive terminal unit mounted in the first housing, the coupling end portion of the first housing being formed with an opening unit; and a second electrical connector including a second housing having a coupling end portion, and a second conductive terminal unit mounted in the second housing, the coupling end portion of the second housing being formed with an opening unit;

a hollow first pivot member having a pivot end connected pivotably to the coupling end portion of the first housing of the first electrical connector such that the first pivot member is rotatable relative to the first housing of the first electrical connector about a first axis, and an open coupling end opposite to the pivot end of the first pivot member along a second axis that is perpendicular to the first axis, the pivot end of the first pivot member being formed with an opening unit;

a hollow second pivot member having a pivot end connected pivotably to the coupling end portion of the second housing of the second electrical connector such that the second pivot member is rotatable relative to the second housing of the second electrical connector about a third axis that is perpendicular to the second axis, and an open coupling end opposite to the pivot end of the second pivot member along the second axis and connected pivotally to the coupling end of the first pivot member such that the second pivot member is rotatable relative to the first pivot member about the second axis, the pivot end of the second pivot member being formed with an opening unit;

a wire unit for interconnecting electrically the first conductive terminal unit of the first electrical connector and the second conductive terminal unit of the second electrical connector, the wire unit extending through the opening unit in the first housing of the first electrical connector and into an assembly of the first and second pivot members via the opening unit in the pivot end of the first pivot member, the wire unit further extending from the assembly of the first and second pivot members via the opening unit in the pivot end of the second pivot member into the second housing of the second electrical connector via the opening unit of the second housing of the second electrical connector;

a first positioning unit disposed between the coupling end portion of the first housing of the first electrical connector and the pivot end of the first pivot member for positioning the first pivot member relative to the first housing of the first electrical connector so as to prevent relative rotation between the first electrical connector and the first pivot member about the first axis;

a second positioning unit disposed between the coupling end portion of the second housing of the second electrical connector and the pivot end of the second pivot member for positioning the second pivot member relative to the second housing of the second electrical connector so as to prevent relative rotation between the second electrical connector and the second pivot member about the third axis; and a third positioning unit disposed between the coupling ends of the first and second pivot members for positioning the second pivot member relative to the first pivot member so as to prevent relative rotation between the first and second pivot members about the second axis.

According to a further aspect of the present invention, an electrical connector assembly comprises:

a first electrical connector including a first housing having a coupling end portion, and a first conductive terminal unit mounted in the first housing, the coupling end portion of the first housing being formed with an opening unit;

a second electrical connector including a second housing having a coupling end portion, and a second conductive terminal unit mounted in the second housing, the coupling end portion of the second housing being formed with an opening unit;

a main housing having opposite open coupling ends;

a pair of pivot units, each of which interconnects pivotally the coupling end portion of a respective one of the first and second housings of the first and second electrical connectors and a respective one of the coupling end portions of the main housing, each of the pivot units including a hollow first pivot member having a pivot end connected pivotally to the coupling end portion of the respective one of the first and second housings of the first and second electrical connectors such that the first pivot member is rotatable relative to the respective one of the first and second housings of the first and second electrical connectors about a first axis, and an open coupling end opposite to the pivot end of the first pivot member along a second axis that is perpendicular to the first axis, the pivot end of the first pivot member being formed with an opening unit, and a hollow second pivot member having a pivot end connected pivotally to the respective one of the coupling ends of the main housing such that the second pivot member is rotatable relative to the respective one of the coupling ends of the main housing about a third axis that is perpendicular to the second axis, and an open coupling end opposite to the pivot end of the second pivot member along the second axis and connected pivotally to the coupling end of the first pivot member such that the second pivot member is rotatable relative to the first pivot member about the second axis, the pivot end of the second pivot member being formed with an opening unit; and a wire unit for interconnecting electrically the first conductive terminal unit of the first electrical connector and the second conductive terminal unit of the second electrical connector, the wire unit extending from the first housing of the first electrical connector via the opening unit in the coupling end portion of the first housing into an assembly of the pivot units and the main housing via the opening unit in the pivot end of the first pivot member of one of the pivot units connected pivotally to the first housing, the wire unit further extending from the assembly of the pivot units and the main housing via the opening unit in the pivot end of the first pivot member of the other one of the pivot units into the second housing of the second electrical connector via the opening unit in the second housing of the second electrical connector.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
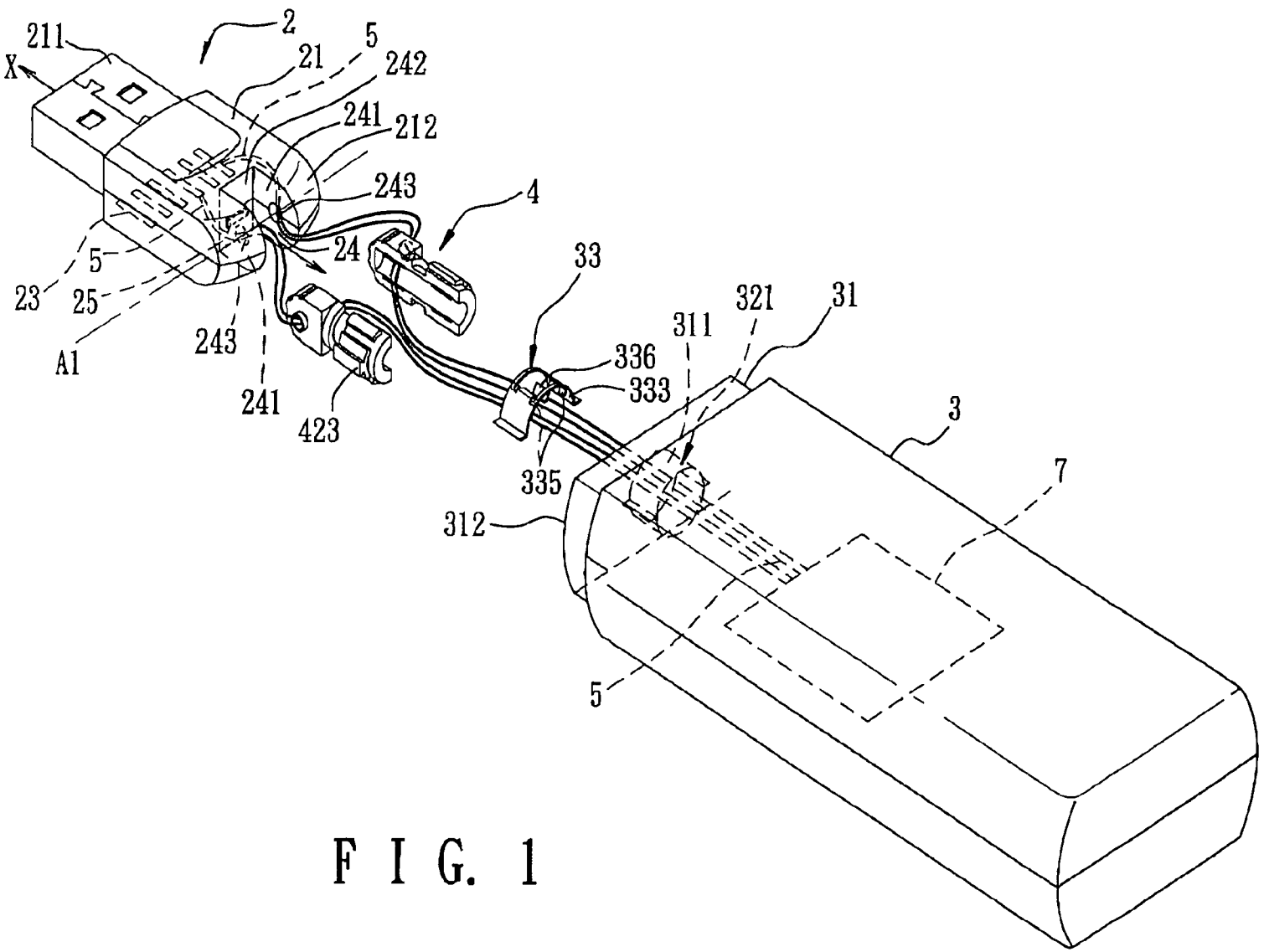
FIG. 1 is a partly exploded perspective view showing an electronic device according to the first preferred embodiment of the present invention.

Before the present invention is described in greater detail, it should be noted that like elements are denoted by the same reference numerals throughout the disclosure.

Figure 2:
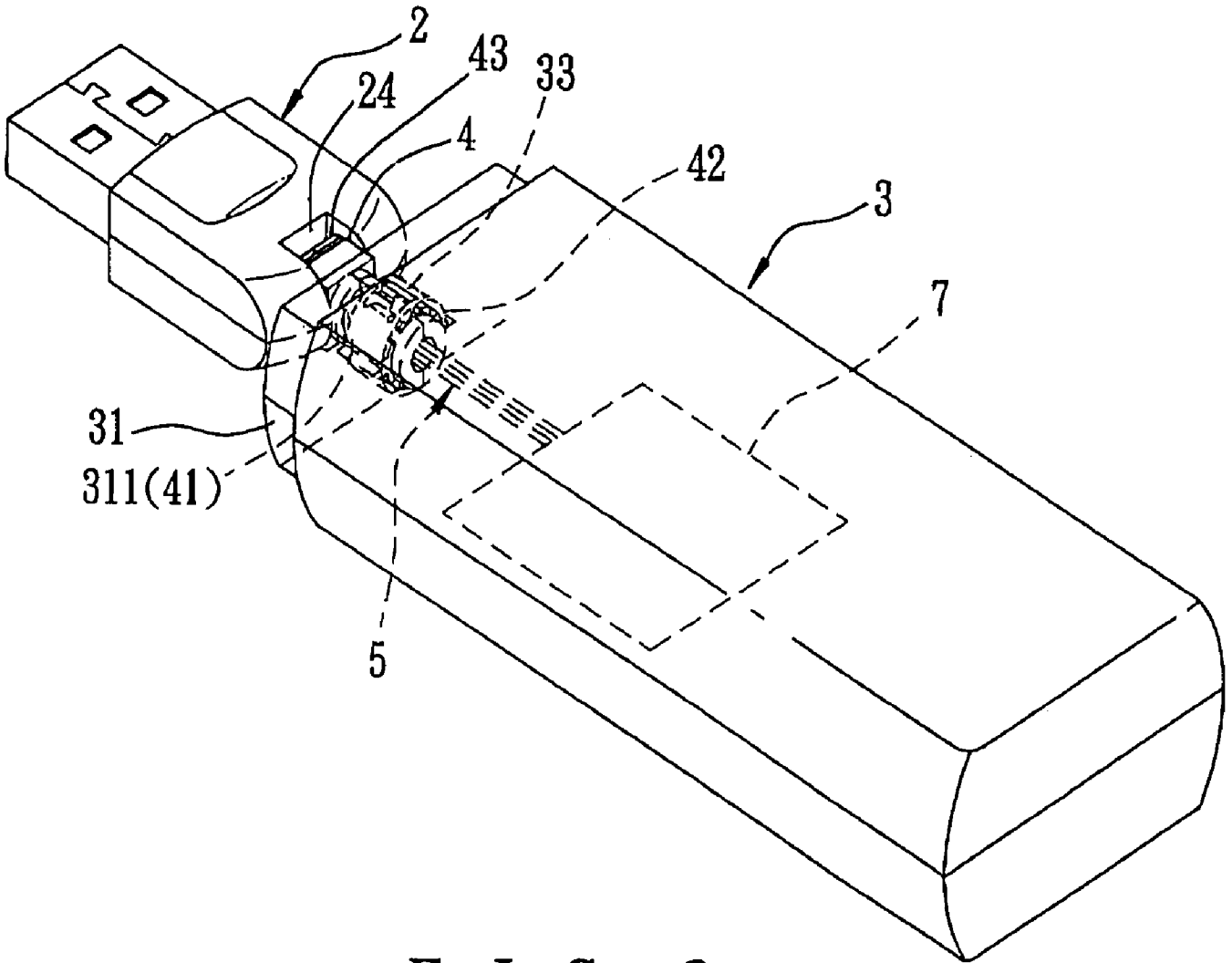
FIG. 2 is an assembled perspective view showing the first preferred embodiment.

Referring to FIGS. 1 and 2, an electronic device according to the first preferred embodiment of the present invention is shown to include a main housing 3, an electrical connector 2, a hollow pivot member 4, a wire unit 5, a first positioning unit, and a second positioning unit.

The main housing 3 is housed with a circuit unit 7, and has a coupling end portion 31 formed with an opening unit that is composed of a pivot hole 311. In this embodiment, the main housing 3 is composed of a pair of complementary housing parts. The circuit unit 7 can function as a card reader, a hub or a wireless network card.

The electrical connector 2 can be in the form of a USB connector, and includes a connector housing 21 and a conductive terminal unit 23. The connector housing 21 has an insertion end portion 211, and a coupling end portion 212 opposite to the insertion end portion 211 in a longitudinal direction (X). The coupling end portion 212 of the connector housing 21 is formed with an opening unit. In this embodiment, the coupling end portion 212 of the connector housing 21 of the electrical connector 2 is formed with a receiving groove 24. The receiving groove 24 is defined by two lateral wall surfaces 241 facing each other along a first axis (A1) that is perpendicular to the longitudinal direction (X), and a connecting wall surface 242 interconnecting the lateral wall surfaces 241. Each lateral wall surface 241 is formed with a pivot hole 243. The pivot holes 243 in the lateral wall surfaces 241 constitute the opening unit in the coupling end portion 212 of the connector housing 21. The conductive terminal unit 23 is mounted in the connector housing 21. In this embodiment, the conductive terminal unit 23 includes a plurality of conductive terminals.

Figure 3:
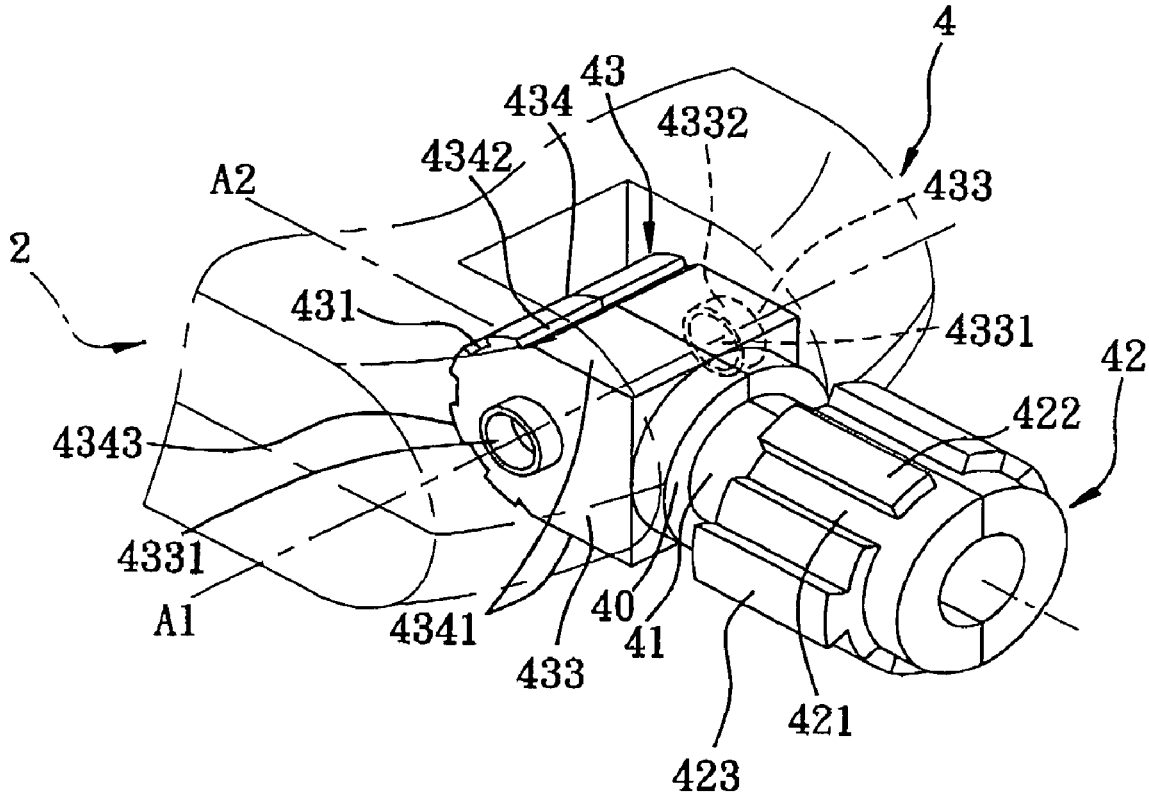
FIG. 3 is a perspective view showing a pivot member of the first preferred embodiment.

With further reference to FIG. 3, the pivot member 4 is composed of a pair of complementary parts connected detachably to each other (see FIG. 1), and has a first pivot end 43, and an open second pivot end 42 opposite to the first pivot end 43 along a second axis (A2) that is perpendicular to the first axis (A1).

Figure 4:
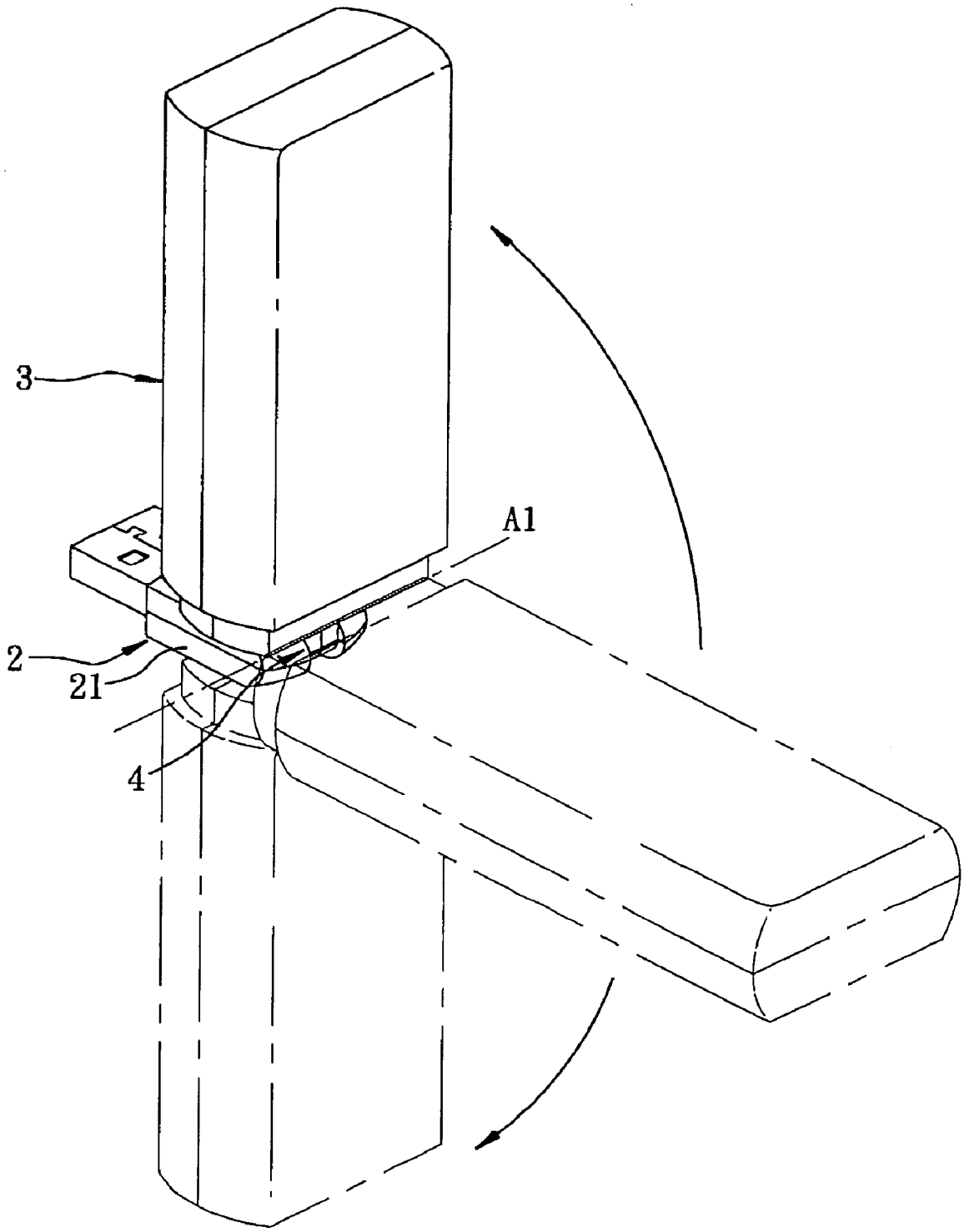
FIG. 4 is a perspective view illustrating how an assembly of the pivot member and a main housing of the first preferred embodiment is rotatable relative to an electrical connector about a first axis.

In this embodiment, the first pivot end 43 is connected pivotally to the coupling end portion 212 of the connector housing 21 such that the pivot member 4 is rotatable relative to the connector housing 21 of the electrical connector 2 about the first axis (A1), as shown in FIG. 4. In this embodiment, the first pivot end 43 of the pivot member 4 is received in the receiving groove 24 in the coupling end portion 212 of the connector housing 21, as shown in FIG. 2. The first pivot end 43 of the pivot member 4 has two lateral walls 433 opposite to each other along the first axis (A1) and disposed between the lateral wall surfaces 241 of the coupling end portion 212 of the connector housing 21, and a U-shaped wall 434 interconnecting the lateral walls 433. Each lateral wall 433 is formed with a through hole 4331, and a tubular pivot rod 4332 aligned with the through hole 4331, extending outwardly along the first axis (A1) and journalled within the pivot hole 243 in a respective one of the lateral wall surfaces 241 of the coupling end portion 212 of the connector housing 21. In this embodiment, the tubular pivot rods 4332 and the through holes 4331 in the lateral walls 433 of the first pivot end 43 of the pivot member 4 constitute an opening unit in the first pivot end 43 of the pivot member 4. The U-shaped wall 434 has opposite straight wall portions 4341, and a connecting wall portion 4342 interconnecting the straight wall portions 4341 and adjacent to the connecting wall surface 242 of the coupling end portion 212 of the connector housing 21. The connecting wall portion 4342 has a curved outer surface 4343.

Figure 5:
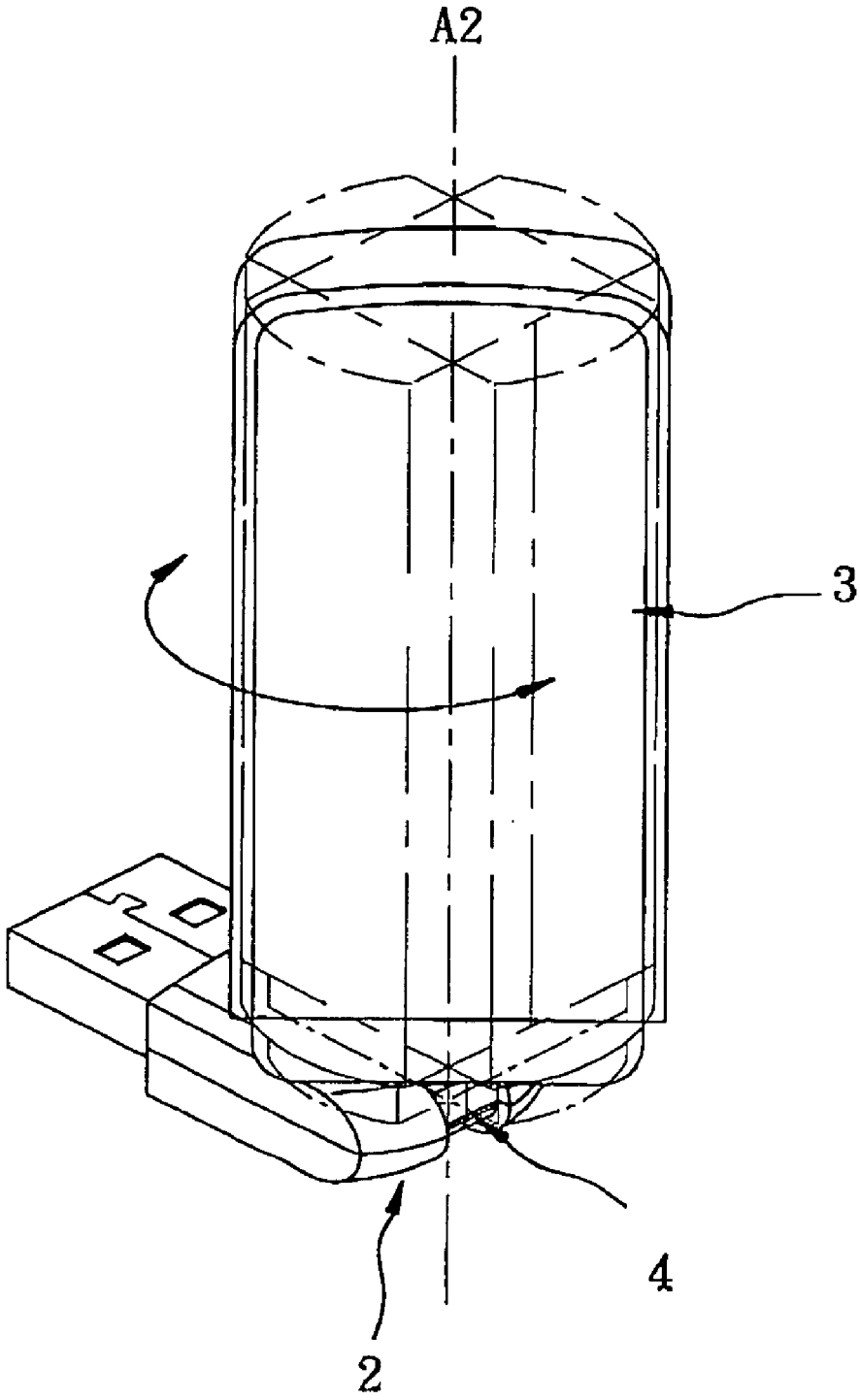
FIG. 5 is a perspective view illustrating how the main housing is rotatable relative to the pivot member about a second axis.

In this embodiment, the second pivot end 42 of the pivot member 4 is disposed in the main housing 3, and is connected pivotally to the coupling end portion 31 of the main housing 3 such that the main housing 3 is rotatable relative to the pivot member 4 about the second axis (A2), as shown in FIG. 5. In this embodiment, the second pivot end 42 is formed as a tubular body, and has an annular outer circumferential surface 422.

In this embodiment, the pivot member 4 further has an annular outer surface formed with an annular groove 40 that is disposed between the first and second pivot ends 43, 42 so as to define an intermediate neck portion 41 interconnecting the first and second pivot ends 43, 42 and journalled within the pivot hole 311 in the coupling end portion 31 of the main housing 3, as shown in FIG. 2.

The wire unit 5 includes a plurality of wires, and interconnects electrically the conductive terminal unit 23 of the electrical connector 2 and the circuit unit 7 in the main housing 3. The wire unit 5 extends through the opening unit (i.e., the pivot holes 243) in the connector housing 21 and into the pivot member 4 via the opening unit (i.e., the tubular pivot rods 4332 and the through holes 4331) in the first pivot end 43 of the pivot member 4. The wire unit 5 further extends from the tubular second pivot end 42 of the pivot member 4 into the main housing 3.

The first positioning unit is disposed between the coupling end portion 212 of the connector housing 21 and the first pivot end 43 of the pivot member 4 for positioning the pivot member 4 relative to the connector housing 21 of the electrical connector 2 so as to prevent relative rotation between the electrical connector 2 and the pivot member 4 about the first axis (A1). In this embodiment, the first positioning unit includes a plurality of positioning grooves 431, and a positioning block 25. The positioning grooves 431 are formed in the curved outer surface 4343 of the connecting wall portion 4342 of the U-shaped wall 434 of the first pivot end 43 of the pivot member 4, are parallel to the first axis (A1), are spaced angularly apart from each other, and are arranged around the first axis (A1), as shown in FIG. 3. The positioning block 25 is formed on the connecting wall surface 242 of the coupling end portion 212 of the connector housing 21 (see FIG. 1), and engages a selected one of the positioning grooves 431.

The second positioning unit is disposed between the coupling end portion 31 of the main housing 3 and the second pivot end 42 of the pivot member 4 for positioning the main housing 3 relative to the pivot member 4 so as to prevent relative rotation between the pivot member 4 and the main housing 3 about the second axis (A2). In this embodiment, the second positioning unit includes a plurality of positioning grooves 421, and a mounting piece 33. The positioning grooves 421 are formed in the outer circumferential surface 422 of the second pivot end 42 of the pivot member 4, are parallel to the second axis (A2), are spaced angularly apart from each other, and are arranged around the second axis (A2), as shown in FIG. 3. The mounting piece 33 is disposed fixedly in the coupling end portion 31 of the main housing 3, and is mounted on the outer circumferential surface 422 of the second pivot end 42 of the pivot member 4 (see FIG. 2). The mounting piece 33 is formed with a resilient abutting portion 336 extending toward the second pivot end 42 of the pivot member 4 (see FIG. 1) and engaging a selected one of the positioning grooves 421.

Furthermore, the outer circumferential surface 422 of the second pivot end 42 of the pivot member 4 is further formed with a position-limiting block 423. The mounting piece 33 is further formed with a plurality of stop stubs 335 rotatable relative to the pivot member 4 to abut against the position-limiting block 423 so as to limit rotation of the second pivot end 42 of the pivot member 4 relative to the main housing 3 within a range from 0° to a predetermined angle less than 360°, thereby preventing wire entanglement.

Figure 6:
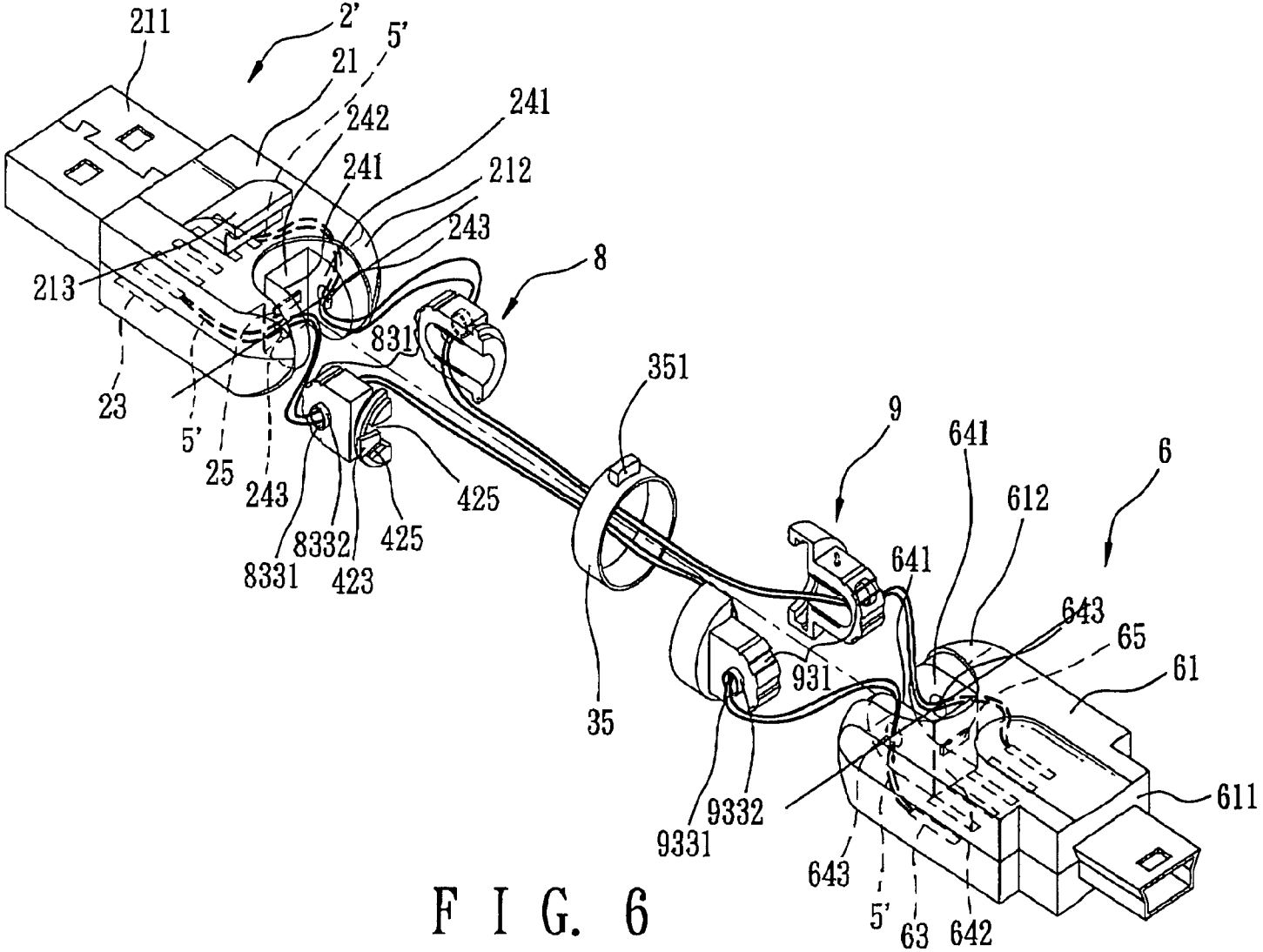
FIG. 6 is a partly exploded perspective view showing an electrical connector assembly according to the second preferred embodiment of the present invention.
Figure 7:
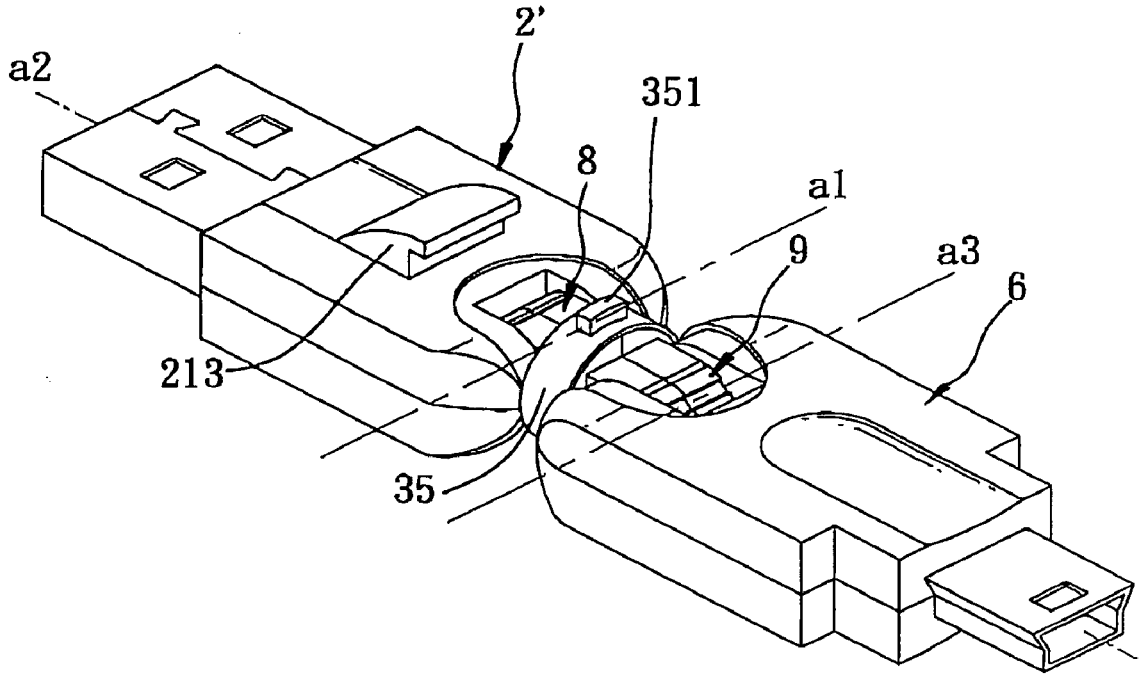
FIG. 7 is an assembled perspective view showing the second preferred embodiment.

Referring to FIGS. 6 and 7, an electrical connector assembly according to the second preferred embodiment of the present invention is shown to include a first electrical connector 2', a second electrical connector 6, a hollow first pivot member 8, a hollow second pivot member 9, a wire unit 5', a first positioning unit, a second positioning unit, and a third positioning unit.

The first electrical connector 2' includes a first housing 21 having a coupling end portion 212, and a first conductive terminal unit 23 mounted in the first housing 21. The first coupling end portion 212 of the first housing 21 of the electrical connector 2' is formed with an opening unit. In this embodiment, the first electrical connector 2' has the same configuration as that of the electrical connector 2 described in the first preferred embodiment of FIG. 1. Thus, a detailed description of the first electrical connector 2' is omitted for the sake of brevity.

The second electrical connector 6 includes a second housing 61 having opposite coupling and insertion end portions 612, 611, and a second conductive terminal unit 63 mounted in the second housing 61. The coupling end portion 612 of the second housing 61 of the second electrical connector 6 is formed with an opening unit. In this embodiment, the second electrical connector 6 has a configuration similar to that of the first electrical connector 2'.

Figure 8:
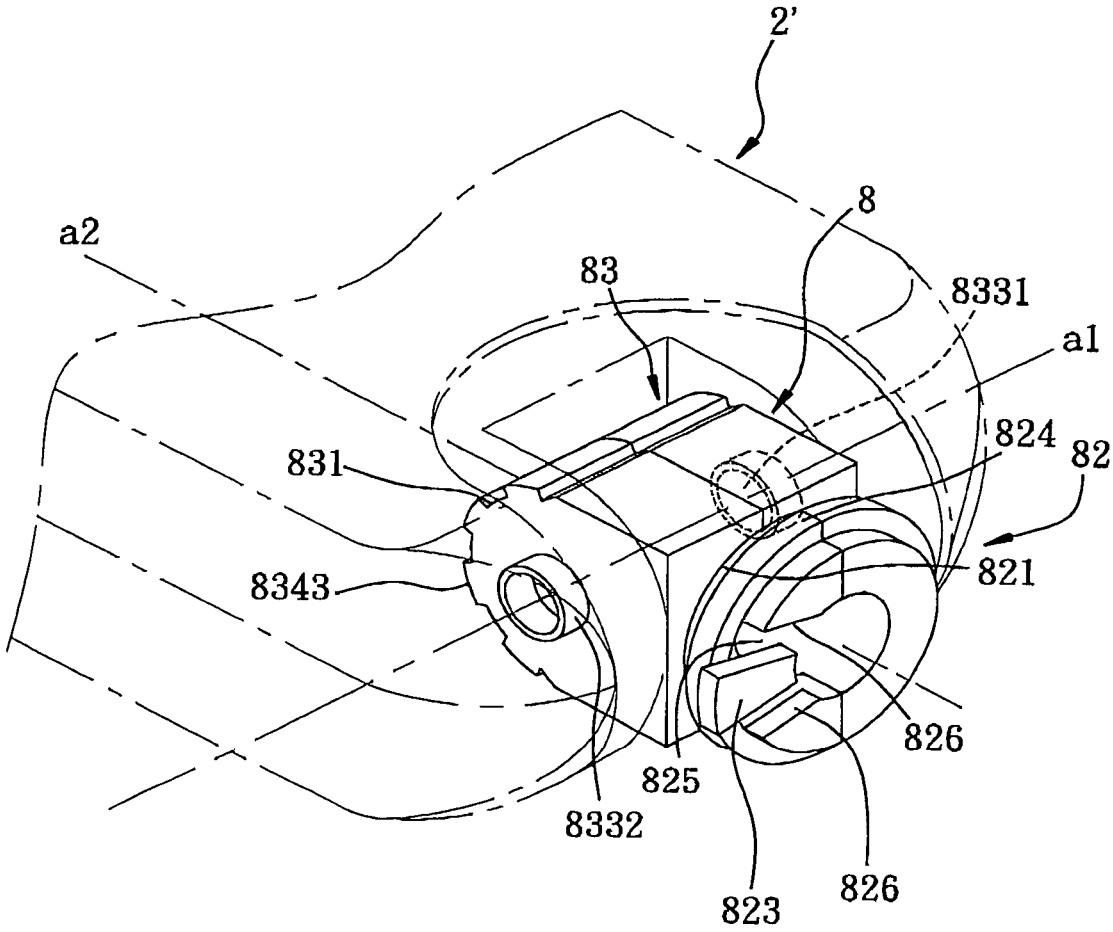
FIG. 8 is a perspective view showing a first pivot member of the second preferred embodiment.

With additional reference to FIG. 8, the first pivot member 8 has a pivot end 83 connected pivotally to the coupling end portion 212 of the first housing 21 of the first electrical connector 2' such that the first pivot member 8 is rotatable relative to the first housing 21 of the first electrical connector 2' about a first axis (a1) (see FIG. 2), and an open coupling end 82 opposite to the pivot end 83 of the first pivot member 8 along a second axis (a2) that is perpendicular to the first axis (a1). In this embodiment, the first pivot member 8 is composed of a pair of complementary parts connected detachably to each other (see FIG. 6). In this embodiment, the pivot end 83 of the first pivot member 8 has the same configuration as that of the first pivot end 43 of the pivot member 4 described in the first preferred embodiment of FIG. 3. In this embodiment, the coupling end 82 of the first pivot member 8 is formed as a tubular body that has an outer circumferential surface 821 formed with an annular engaging flange 824 extending radially and outwardly therefrom.

Figure 9:
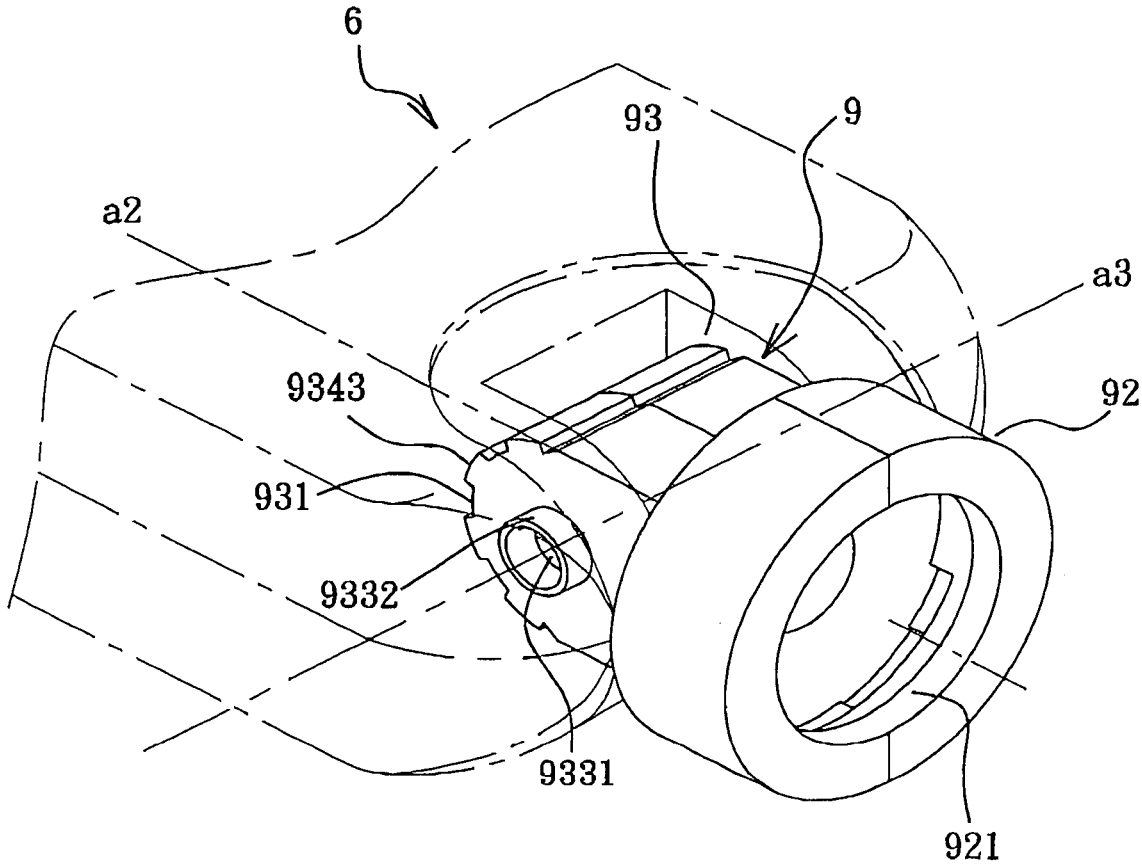
FIG. 9 is a perspective view showing a second pivot member of the second preferred embodiment.
Figure 10:
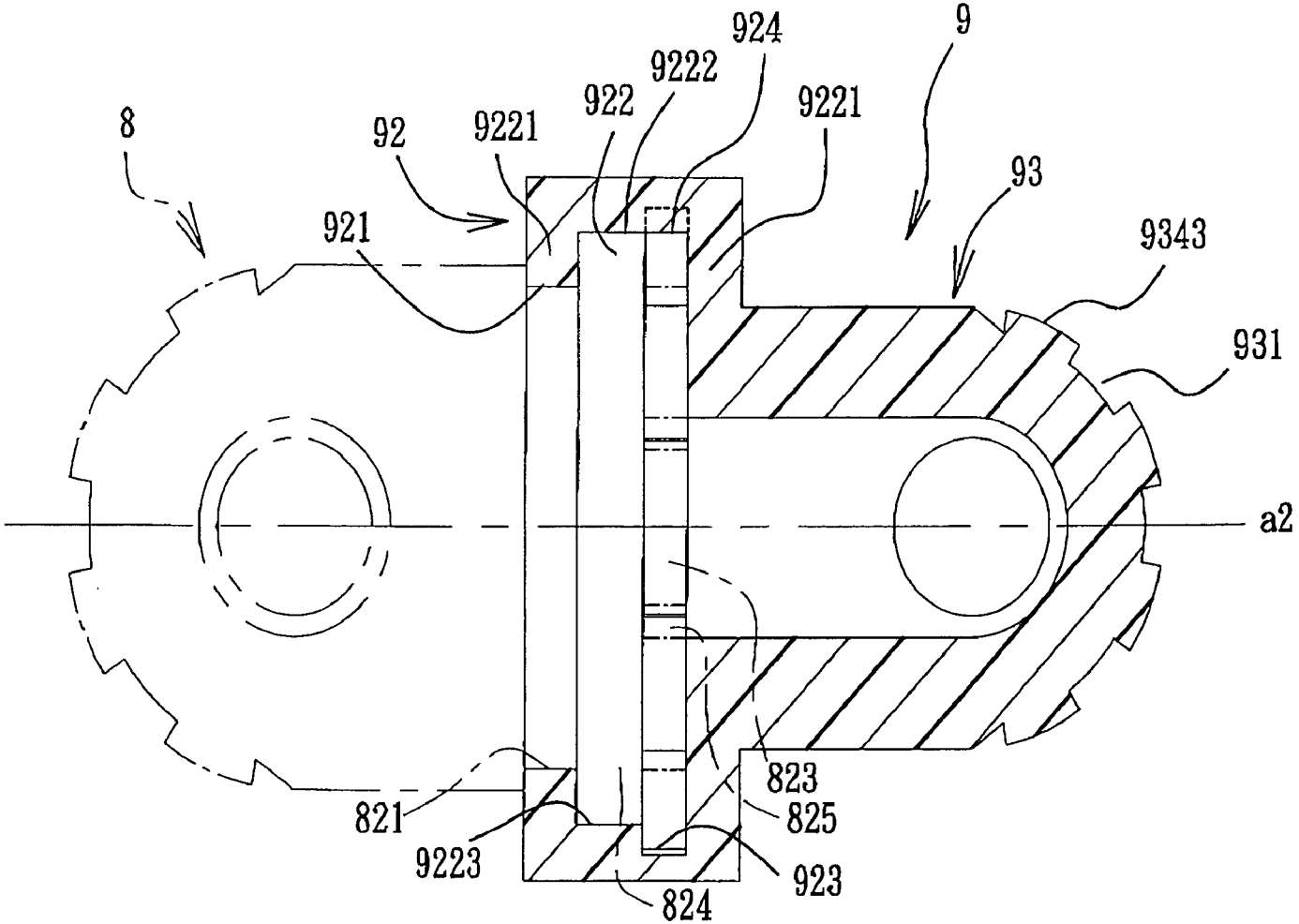
FIG. 10 is a schematic sectional view showing the second pivot member of the second preferred embodiment.
Figure 11:
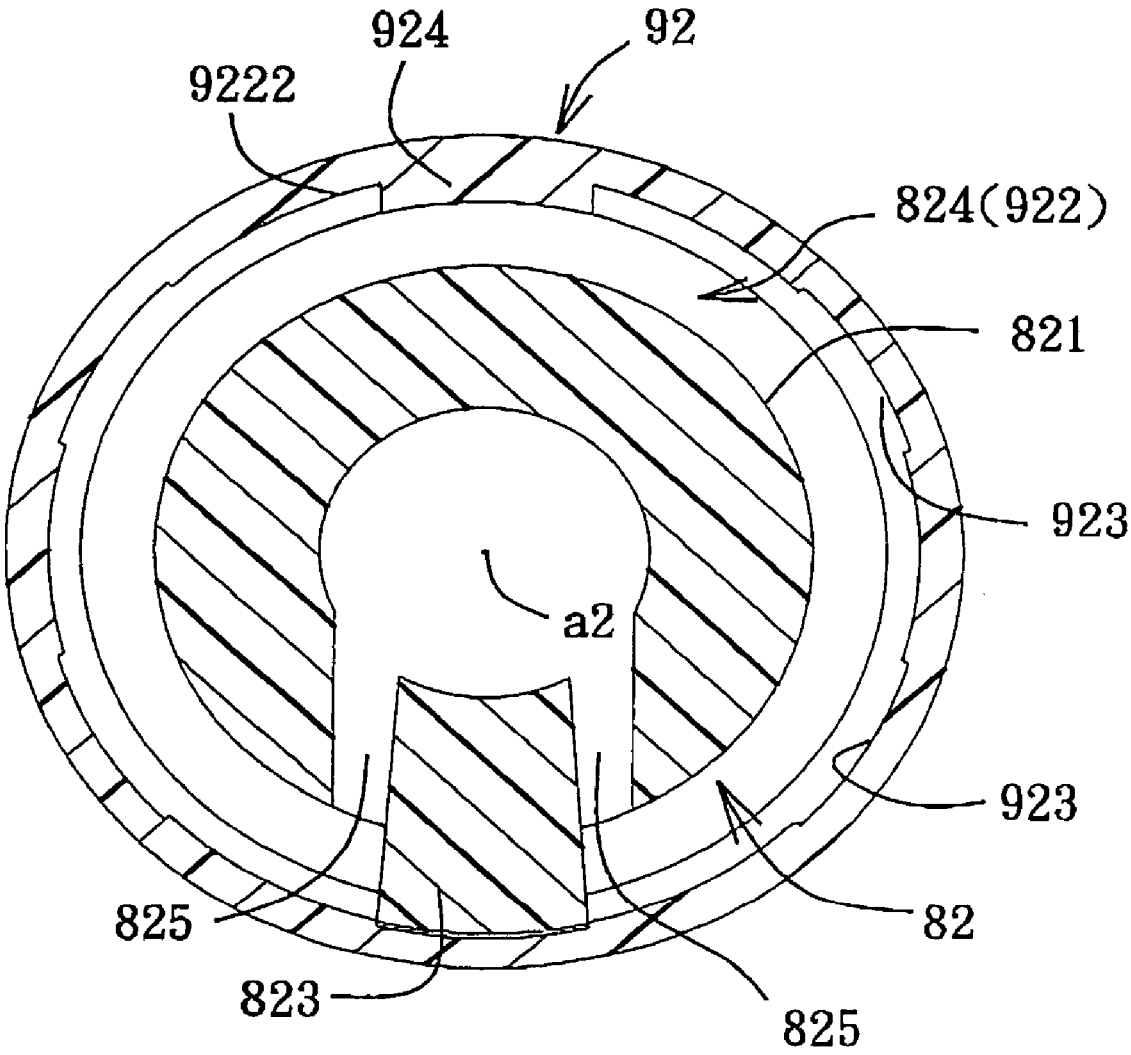
FIG. 11 is a schematic sectional view showing an assembly of the first and second pivot members of the second preferred embodiment.
Figure 12:
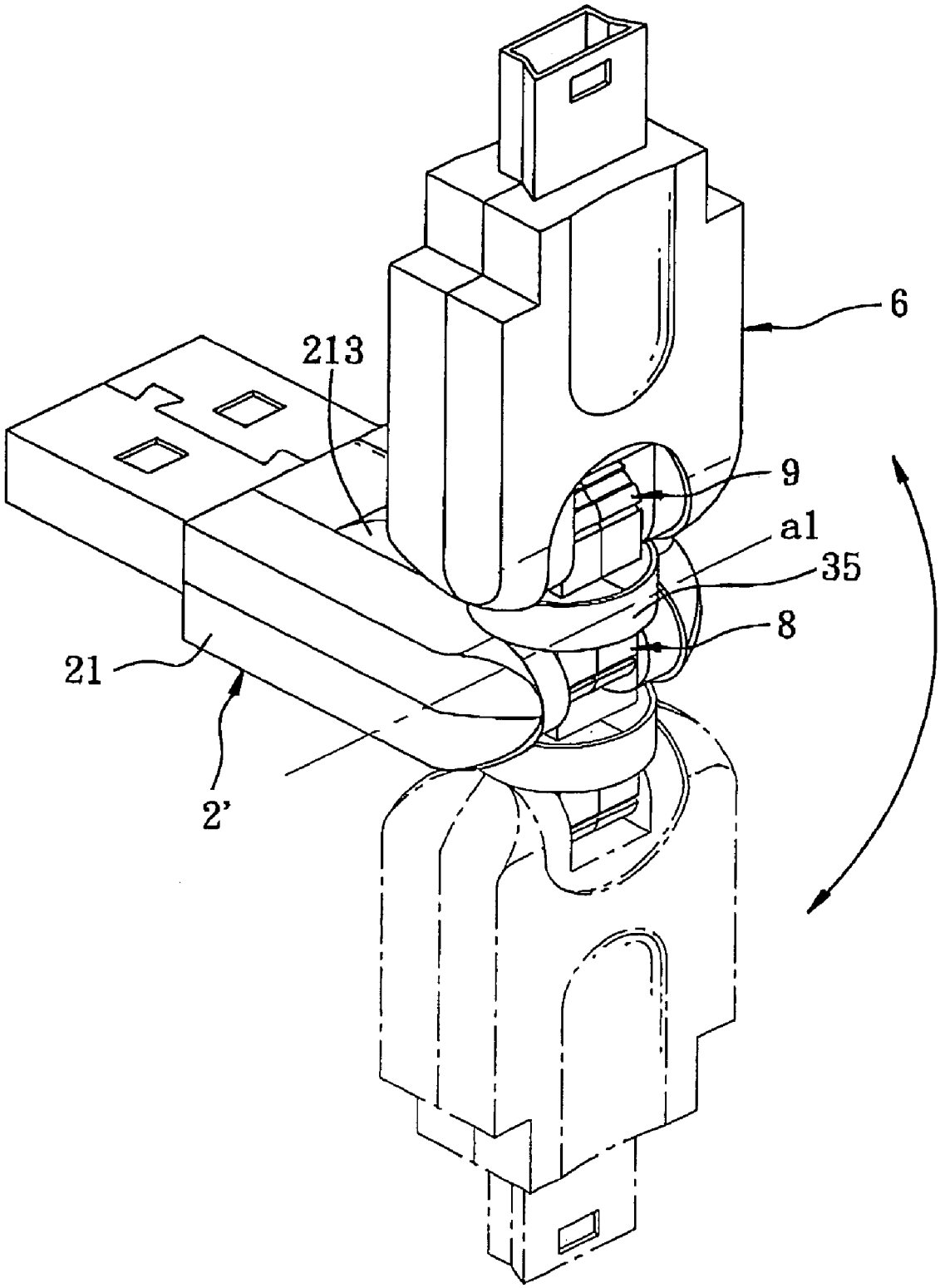
FIG. 12 is a perspective view illustrating how an assembly of the first and second pivot members and a second electrical connector of the second preferred embodiment is rotatable relative to a first electrical connector about a first axis.
Figure 13:
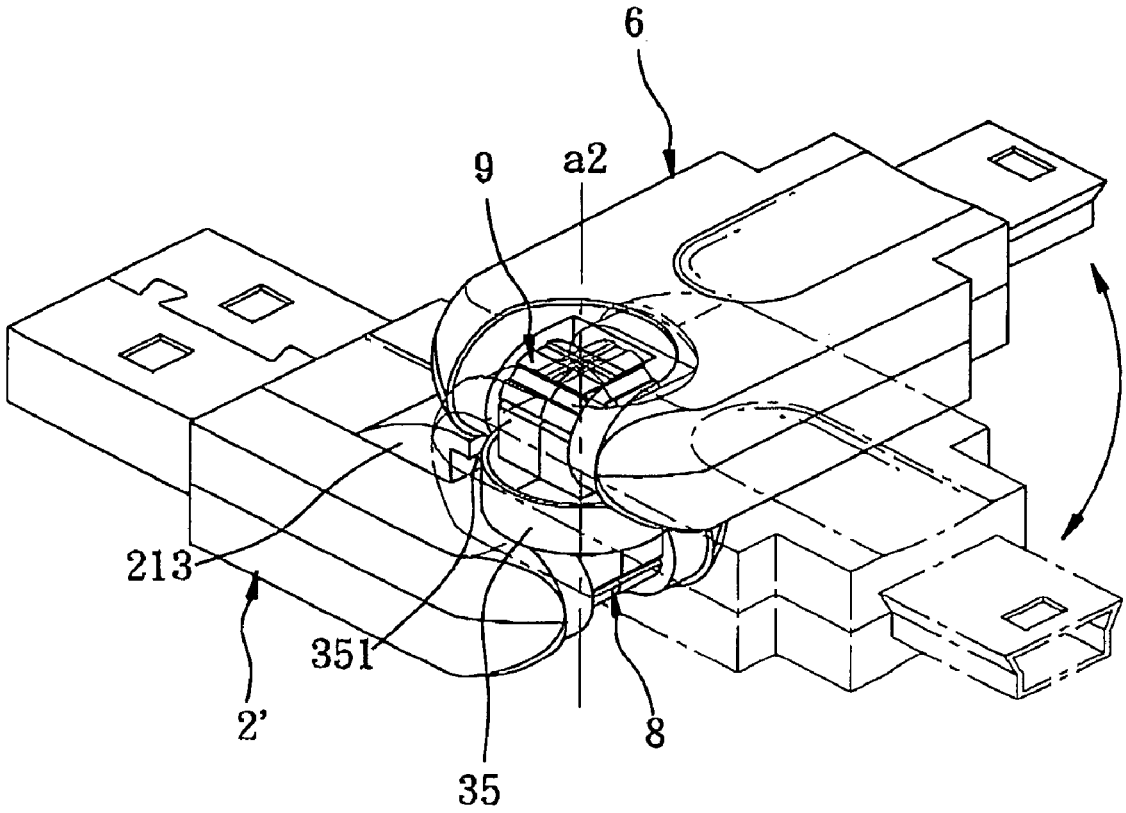
FIG. 13 is a perspective view illustrating how an assembly of the second electrical connector and the second pivot member is rotatable relative to the first pivot member about a second axis.
Figure 14:
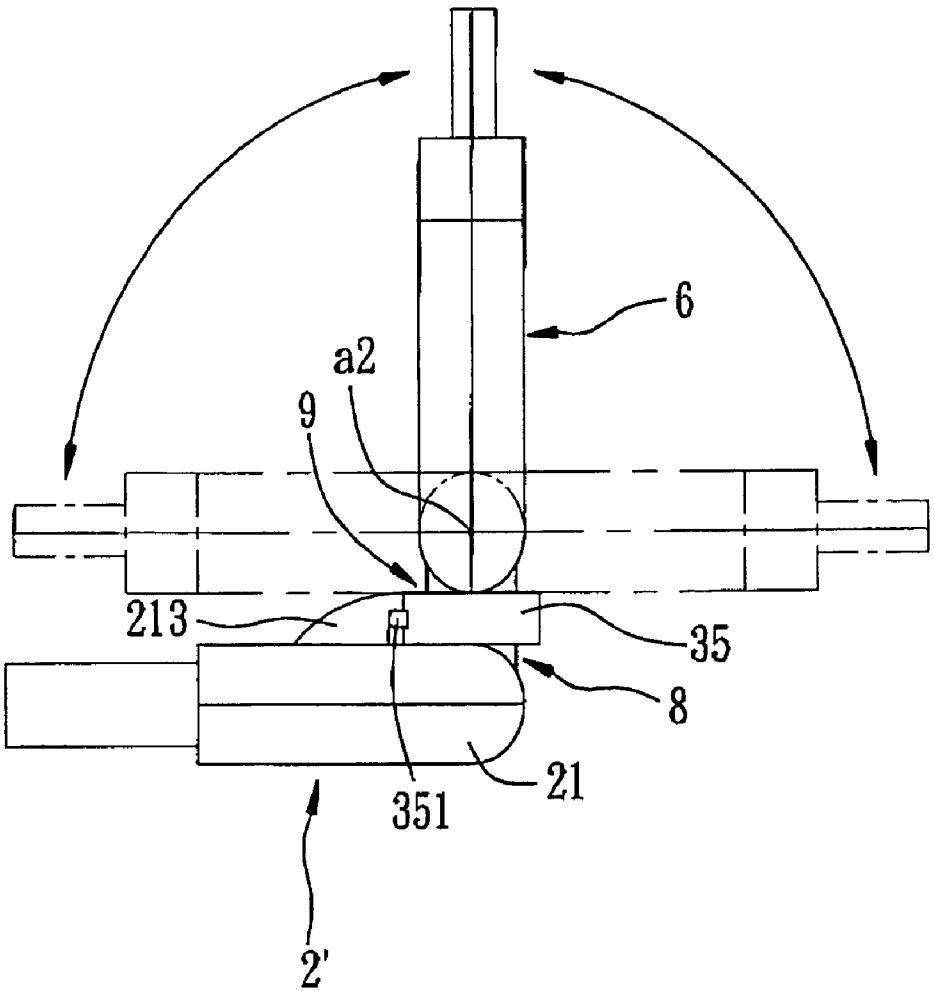
FIG. 14 is a perspective view illustrating how the second electrical connector is rotatable relative to the second pivot member about a third axis.

With additional reference to FIGS. 9 to 11, the second pivot member 9 has a pivot end 93 connected pivotally to the coupling end portion 612 of the second housing 61 of the second electrical connector 6 such that the second pivot member 9 is rotatable relative to the second housing 61 of the second electrical connector 6 about a third axis (a3) that is perpendicular to the second axis (a2), as shown in FIG. 14, and an open coupling end 92 opposite to the pivot end 93 of the second pivot member 9 along the second axis (a2) and connected pivotally to the coupling end 82 of the first pivot member 8 such that the second pivot member 9 is rotatable relative to the first pivot member 8 about the second axis (a2) (see FIG. 13). In this embodiment, the second pivot member 9 is composed of a pair of complementary parts connected detachably to each other (see FIG. 6) In this embodiment, the pivot end 93 of the second pivot member 9 has a configuration similar to that of the pivot end 83 of the first pivot member 8. In this embodiment, the coupling end 92 of the second pivot member 9 is formed as a tubular body that is sleeved on the outer circumferential surface 821 of the coupling end 82 of the first pivot member 8 and that has an inner circumferential surface 921 formed with an annular engaging groove 922, as best shown in FIG. 10. The annular engaging flange 824 on the coupling end 82 of the first pivot member 8 engages rotatably the annular engaging groove 922 in the coupling end 92 of the second pivot member 9. In this embodiment, the annular engaging groove 922 is defined by opposite groove lateral walls 9221, and a groove bottom wall 9222 interconnecting the groove lateral walls 9221, as shown in FIG. 10.

As shown in FIG. 6, the wire unit 5' includes a plurality of wires, and interconnects electrically the first conductive terminal unit 23 of the first electrical connector 2' and the second conductive terminal unit 63 of the second electrical connector 6. The wire unit 5' extends through the opening unit (the pivot holes 243) in the first housing 21 of the first electrical connector 2' and into an assembly of the first and second pivot members 8 and 9 via the opening unit (the through holes 8331 and the tubular pivot rods 8332) of the pivot end 83 of the first pivot member 8. The wire unit 5' further extends from the assembly of the first and second pivot members 8, 9 via the opening unit (the through holes 9331 and the tubular pivot rods 9332) in the pivot end 93 of the second pivot member 9 into the second housing 61 of the second electrical connector 6 via the opening unit (the pivot holes 643) in the second housing 61 of the second electrical connector 6.

The first positioning unit is disposed between the coupling end portion 212 of the first housing 21 of the first electrical connector 2' and the pivot end 83 of the first pivot member 8 for positioning the first pivot member 8 relative to the first housing 21 of the first electrical connector 2' so as to prevent relative rotation between the first electrical connector 2' and the first pivot member 8 about the first axis (a1). In this embodiment, the first positioning unit has the same configuration as that of the first positioning unit described in the first preferred embodiment of FIG. 1. That is, the first positioning unit includes a plurality of positioning grooves 831 formed in the curved outer surface 8343 of the pivot end 83 of the first pivot member 8, parallel to the first axis (a1), spaced angularly apart from each other, and arranged around the first axis (a1), and a positioning block 25 formed on the connecting wall surface 242 of the coupling end portion 212 of the first housing 21 and engaging a selected one of the positioning grooves 831.

The second positioning unit is disposed between the coupling end portion 612 of the second housing 61 of the second electrical connector 6 and the pivot end 93 of the second pivot member 9 for positioning the second pivot member 9 relative to the second housing 61 of the second electrical connector 6 so as to prevent relative rotation between the second electrical connector 6 and the second pivot member 9 about the third axis (a3). In this embodiment, the second positioning unit has a configuration similar to that of the first positioning unit. That is, the second positioning unit includes a plurality of positioning grooves 931 formed in the curved outer surface 9343 of the pivot end 93 of the second pivot member 9, parallel to the third axis (a3), spaced angularly apart from each other, and arranged around the third axis (a3), and a positioning block 65 formed on the connecting wall surface 642 of the coupling end portion 212 of the first housing 21 and engaging a selected one of the positioning grooves 931.

The third positioning unit is disposed between the coupling ends 82, 92 of the first and second pivot members 8, 9 for positioning the second pivot member 9 relative to the first pivot member 8 so as to prevent relative rotation between the first and second pivot members 8, 9 about the second axis (a2). In this embodiment, referring to FIGS. 8, 10 and 11, the third positioning unit includes a plurality of positioning recesses 923, and a positioning block 823. The positioning recesses 923 are formed in an annular inner surface 9223 of the groove bottom wall 9222 of the coupling end 92 of the second pivot member 9, are spaced angularly apart from each other, and are arranged around the second axis (a2), as best shown in FIG. 11. The positioning block 823 is formed integrally with the annular engaging flange 824 of the first pivot member 8, and engages a selected one of the positioning recesses 923. The annular engaging flange 824 of the first coupling end 82 of the pivot member 8 is formed with a circumferentially extending C-shaped projection 825 having two ends 826, as shown in FIG. 8. The positioning block 823 is disposed between and is spaced apart from the ends 826 of the C-shaped projection 825, as shown in FIG. 8. The annular inner surface 9223 of the groove bottom wall 9222 of the coupling end 92 of the second pivot member is disposed around and is in slidable contact with an assembly of the positioning block 823 and the C-shaped projection 825, as shown in FIG. 10.

It is noted that the groove bottom wall 9222 of the coupling end 92 of the second pivot member 9 is further formed with a stop block 924 that is rotatable relative to the first pivot member 8 to abut against the positioning block 823 so as to limit rotation of the first pivot member 8 relative to the second pivot member 9 within a range from 0° to a predetermined angle less than 360°, thereby preventing wire entanglement.

The electrical connector assembly further includes a coupling ring 35 sleeved on the coupling end 92 of the second pivot member 9 in a close fitting manner and disposed between the first and second housings 21, 61 of the first and second electrical connectors 2', 6 so as to prevent separation of the first and second pivot members 8, 9 from each other, as shown in FIG. 2. Furthermore, the first housing 21 of the first electrical connector 2' has an engaging lug 213. The coupling ring 35 has an annular outer surface formed with an engaging stub 351 that engages the engaging lug 213 of the first housing 21 of the first electrical connector 2' when the first pivot member 8 is perpendicular to the first housing 21 of the first electrical connector 2', as shown in FIG. 14.

Figure 15:
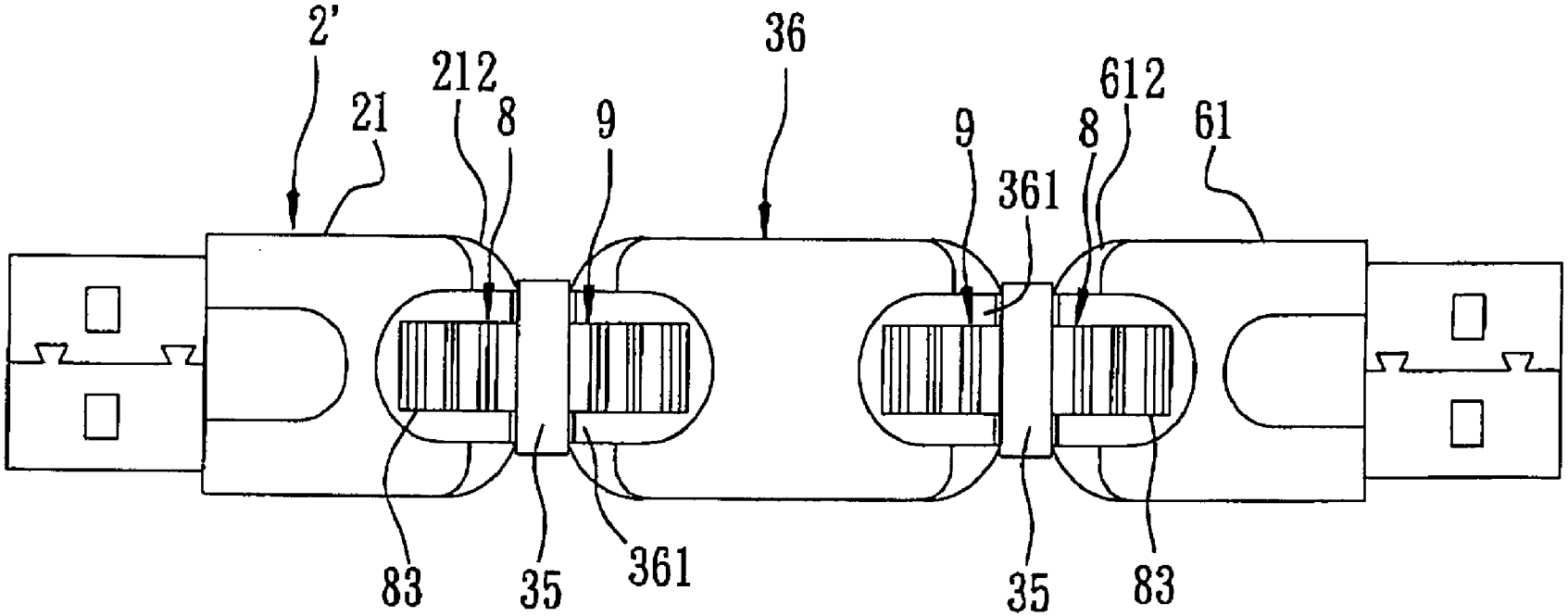
FIG. 15 is a schematic view showing an electrical connector assembly according to the third preferred embodiment of the present invention.

Referring to FIG. 15, an electrical connector assembly according to the third preferred embodiment of the present invention is shown to include the aforementioned first and second electrical connectors 2', 6, a main housing 36, a pair of pivot units, and a wire unit (not shown).

The main housing 36 has opposite open coupling ends coupling end portions 212, 612 of the first and second housings 21, 61.

Each of the pivot units interconnects pivotally the coupling end portion 212, 612 of a respective one of the first and second housings 21, 61 of the first and second electrical connectors 2', 6 and a respective one of the coupling ends 361 of the main housing 36. In this embodiment, each pivot unit is composed of an assembly of the first and second pivot members 8, 9 described in the second preferred embodiment.

The wire unit interconnects electrically the first and second conductive terminal units (not shown) of the first and second electrical connectors 2', 6. The wire unit extends from the first housing 21 of the first electrical connector 2' via the opening unit (not shown) in the coupling end portion 212 of the first housing 21 into an assembly of the pivot units and the main housing 36 via the opening unit (not shown) in the pivot end 83 of the first pivot member 8 of one of the pivot units connected pivotally to the first housing 21. The wire unit further extends from the assembly of the pivot units and the main housing 36 via the opening unit (not shown) in the pivot end 83 of the first pivot member 83 of the other one of the pivot units into the second housing 61 of the second electrical connector 6 via the opening unit (not shown) in the second housing 61 of the second electrical connector 6.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. An electrical connector assembly comprising:

a first electrical connector including a first housing having a coupling end portion, and a first conductive terminal unit mounted in said first housing, said coupling end portion of said first housing being formed with an opening unit;

a second electrical connector including a second housing having a coupling end portion, and a second conductive terminal unit mounted in said second housing, said coupling end portion of said second housing being formed with an opening unit;

a hollow first pivot member having a pivot end connected pivotably to said coupling end portion of said first housing of said first electrical connector such that said first pivot member is rotatable relative to said first housing of said first electrical connector about a first axis, and an open coupling end opposite to said pivot end of said first pivot member along a second axis that is perpendicular to the first axis, said pivot end of said first pivot member being formed with an opening unit;

a hollow second pivot member having a pivot end connected pivotably to said coupling end portion of said second housing of said second electrical connector such that said second pivot member is rotatable relative to said second housing of said second electrical connector about a third axis that is perpendicular to the second axis, and an open coupling end opposite to said pivot end of said second pivot member along the second axis and connected pivotally to said coupling end of said first pivot member such that said second pivot member is rotatable relative to said first pivot member about the second axis, said pivot end of said second pivot member being formed with an opening unit;

a wire unit for interconnecting electrically said first conductive terminal unit of said first electrical connector and said second conductive terminal unit of said second electrical connector, said wire unit extending through said opening unit in said first housing of said first electrical connector and into an assembly of said first and second pivot members via said opening unit in said pivot end of said first pivot member, said wire unit further extending from the assembly of said first and second pivot members via said opening unit in said pivot end of said second pivot member into said second housing of said second electrical connector via said opening unit in said second housing of said second electrical connector;

a first positioning unit disposed between said coupling end portion of said first housing of said first electrical connector and said pivot end of said first pivot member for positioning said first pivot member relative to said first housing of said first electrical connector so as to prevent relative rotation between said first electrical connector and said first pivot member about the first axis;

a second positioning unit disposed between said coupling end portion of said second housing of said second electrical connector and said pivot end of said second pivot member for positioning said second pivot member relative to said second housing of said second electrical connector so as to prevent relative rotation between said second electrical connector and said second pivot member about the third axis; and a third positioning unit disposed between said coupling ends of said first and second pivot members for positioning said second pivot member relative to said first pivot member so as to prevent relative rotation between said first and second pivot members about the second axis.

2. The electrical connector assembly as claimed in claim 1, wherein:

said coupling end portion of said first housing of said first electrical connector is formed with a receiving groove for receiving said pivot end of said first pivot member, said receiving groove being defined by two lateral wall surfaces facing each other along the first axis, and a connecting wall surface interconnecting said lateral wall surfaces, each of said lateral wall surfaces being formed with a pivot hole, said pivot holes in said lateral wall surfaces constituting said opening unit in said coupling end portion of said first housing of said first electrical connector; and said pivot end of said first pivot member has two lateral walls opposite to each other along the first axis and disposed between said lateral wall surfaces of said coupling end portion of said first housing of said first electrical connector, and a U-shaped wall interconnecting said lateral walls, each of said lateral walls being formed with a through hole, and a tubular pivot rod aligned with said through hole, extending outwardly along the first axis and journalled within said pivot hole in a respective one of said lateral wall surfaces of said coupling end portion of said first housing of said first electrical connector, said tubular pivot rods and said through holes in said lateral walls of said pivot end of said first pivot member constituting said opening unit in said pivot end of said first pivot member.

3. The electrical connector assembly as claimed in claim 2, wherein:

said U-shaped wall has opposite straight wall portions, and a connecting wall portion interconnecting said straight wall portions and adjacent to said connecting wall surface of said coupling end portion of said first housing of said first electrical connector, said connecting wall portion having a curved outer surface; and said first positioning unit includes a plurality of positioning grooves formed in said curved outer surface of said connecting wall portion of said U-shaped wall of said pivot end of said first pivot member, parallel to the first axis, spaced angularly apart from each other, and arranged around the first axis, and a positioning block formed on said connecting wall surface of said coupling end portion of said first housing of said first electrical connector and engaging a selected one of said positioning grooves.

4. The electrical connector assembly as claimed in claim 1, wherein;

said coupling end portion of said second housing of said second electrical connector is formed with a receiving groove for receiving said pivot end of said second pivot member, said receiving groove being defined by two lateral wall surfaces facing each other along the third axis, and a connecting wall surface interconnecting said lateral wall surfaces, each of said lateral wall surfaces being formed with a pivot hole, said pivot holes in said lateral wall surfaces constituting said opening unit of said coupling end portion of said second housing of said second electrical connector; and said pivot end of said second pivot member has two lateral walls opposite to each other along the third axis and disposed between said lateral wall surfaces of said coupling end portion of said second housing of said second electrical connector, and a U-shaped wall interconnecting said lateral walls, each of said lateral walls being formed with a through hole, and a tubular pivot rod aligned with said through hole, extending outwardly along the third axis and journalled within said pivot hole in a respective one of said lateral wall surfaces of said coupling end portion of said second housing of said second electrical connector, said tubular pivot rods and said through holes in said lateral walls of said pivot end of said second pivot member constituting said opening unit of said pivot end of said second pivot member.

5. The electrical connector assembly as claimed in claim 4, wherein:

said U-shaped wall has opposite straight wall portions, and a connecting wall portion interconnecting said straight wall portions and adjacent to said connecting wall surface of said coupling end portion of said second housing of said second electrical connector, said connecting wall portion having a curved outer surface; and said second positioning unit includes a plurality of positioning grooves formed in said curved outer surface of said connecting wall portion of said U-shaped wall of said pivot end of said second pivot member, parallel to the third axis, spaced angularly apart from each other, and arranged around the third axis, and a positioning block formed on said connecting wall surface of said coupling end portion of said second housing of said second electrical connector and engaging a selected one of said positioning grooves.

6. The electrical connector assembly as claimed in claim 1, wherein:

said coupling end of said first pivot member is formed as a tubular body that has an annular outer circumferential surface formed with an annular engaging flange extending radially and outwardly therefrom; and said coupling end of said second pivot member is formed as a tubular body that is sleeved on said outer circumferential surface of said coupling end of said first pivot member and that has an inner circumferential surface formed with an annular engaging groove, said annular engaging flange on said coupling end of said first pivot member engaging rotatably said annular engaging groove in said coupling end of said second pivot member.

7. The electrical connector assembly as claimed in claim 6, wherein:

said annular engaging groove in said inner circumferential surface of said coupling end of said second pivot member is defined by opposite groove lateral walls, and a groove bottom wall interconnecting said groove lateral walls; and said third positioning unit includes a plurality of positioning recesses formed in an inner surface of said groove bottom wall of said coupling end of said second pivot member, spaced angularly apart from each other, and arranged around the second axis, and a positioning block formed integrally with said annular engaging flange of said first pivot member and engaging a selected one of said positioning recesses.

8. The electrical connector assembly claimed in claim 7, wherein said groove bottom wall of said coupling end of said second pivot member is further formed with a stop block that is rotatable relative to said first pivot member to abut against said positioning block so as to limit rotation of said first pivot member relative to said second pivot member within a range from 0° to a predetermined angle less than 360°.

9. The electrical connector assembly as claimed in claim 7, wherein said annular engaging flange of said first coupling end of said first pivot member is formed with a circumferentially extending C-shaped projection having two ends, said positioning block being disposed between and being spaced apart from said ends of said C-shaped projection, said inner surface of said groove bottom wall of said coupling end of said second pivot member being disposed around and being in slidable contact with an assembly of said positioning block and said C-shaped projection.

10. The electrical connector assembly as claimed in claim 7, further comprising a coupling ring sleeved on said coupling end of said second pivot member in a close fitting manner so as to prevent separation of said first and second pivot members from each other.

11. The electrical connector assembly as claimed in claim 10, wherein said first housing has an engaging lug, said coupling ring having an annular outer surface formed with an engaging stub that engages said engaging lug when said first pivot member is perpendicular to said first housing.

* * * * *